US007210901B2

(12) United States Patent
Imbourg et al.

(10) Patent No.: US 7,210,901 B2
(45) Date of Patent: May 1, 2007

(54) ASSEMBLY OF SECTORS OF A DISPENSING UNIT IN A GAS TURBINE

(75) Inventors: Sebastien Imbourg, Yerres (FR); Philippe Pabion, Vaux le Penil (FR); Jean-Luc Soupizon, Vaux le Penil (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/487,729

(22) PCT Filed: Sep. 11, 2002

(86) PCT No.: PCT/FR02/03091

§ 371 (c)(1),
(2), (4) Date: Feb. 25, 2004

(87) PCT Pub. No.: WO03/023193

PCT Pub. Date: Mar. 20, 2003

(65) Prior Publication Data

US 2004/0206871 A1 Oct. 21, 2004

(30) Foreign Application Priority Data

Sep. 13, 2001 (FR) ..... 01 11830

(51) Int. Cl.
*F01D 9/04* (2006.01)

(52) U.S. Cl. ..... 415/190; 415/209.3

(58) Field of Classification Search ..... 248/231.8, 248/71, 74.2, 304; 15/189, 186, 209.3, 209.4; 415/189, 186, 209.3, 209.4
See application file for complete search history.

(56) References Cited

U.S. PATENT DOCUMENTS

| | | | | |
|---|---|---|---|---|
| 3,892,497 | A | 7/1975 | Gunderlock et al. | |
| 5,131,813 | A | 7/1992 | Horvath et al. | |
| 5,618,161 | A | 4/1997 | Papageorgiou et al. | |
| 5,653,410 | A * | 8/1997 | Stroeters et al. | 248/73 |
| 5,669,757 | A | 9/1997 | Brackett | |
| 6,086,021 | A * | 7/2000 | Duhr et al. | 248/73 |
| 6,481,959 | B1 * | 11/2002 | Morris et al. | 415/115 |
| 6,655,911 | B2 * | 12/2003 | Bekrenev | 415/116 |
| 6,857,168 | B2 * | 2/2005 | Lubera et al. | 24/293 |
| 6,896,038 | B2 * | 5/2005 | Arilla et al. | 165/47 |
| 2003/0006347 | A1 * | 1/2003 | Ogden | 248/58 |
| 2005/0042081 | A1 * | 2/2005 | Girard et al. | 415/173.4 |

FOREIGN PATENT DOCUMENTS

| | | |
|---|---|---|
| DE | 936 900 | 12/1955 |
| GB | 856 599 | 12/1960 |

* cited by examiner

*Primary Examiner*—Amy J Sterling
(74) *Attorney, Agent, or Firm*—Oblon, Spivak, McClelland, Maier & Neustadt, P.C.

(57) ABSTRACT

The retaining hooks (32) of a flange (22) of straightening sectors (20), bearing fixed blades in a turbomachine, are advantageously placed on an end plate (30) distinct from the casing (21) but assembled on the latter. In this way, these hooks no longer constitute weak points in the casing, as if they were all in one piece with it, assembly of the sectors (20) is facilitated, and the assembly is more rigid.

6 Claims, 2 Drawing Sheets

ASSEMBLY OF SECTORS OF A DISPENSING UNIT IN A GAS TURBINE

BACKGROUND OF THE INVENTION

1. Field of the Invention

The present invention relates to assembling distributor sectors, bearing fixed blades, and ensuring correction of a gas flow in a casing enclosing stators of a turbomachine.

2. Description of the Related Art

The external flow of gases in turbomachines is delimited by distributor and ferrule sectors alternately mounted on the casing via overlapping hooks along the machine. With reference to FIG. 1, which illustrates an already known assembly, a straightening sector 1 bears a pair of assembly flanges 2 and 3, respectively at the front and at the rear, and which are both fitted with end hooks 4 and 5, extending in the longitudinal direction of the machine. The end hook 4 at the front is placed on a hook 6 of a casing 7 by a pair of mutual support faces 8, which hold the sectors 1 against centripetal radial movements in the machine; the end hook 5 of the other flange 3 abuts radially towards the outside against the casing 7 by a pair of faces 9, and towards the rear, against a second hook 10 of the casing 7, by a pair of flat stop faces 11. A clip 12 is placed around the second hook 10 below the second end hook 5 to also guard the sectors 1 against centripetal movements. The sectors 7 comprise more projections 13 towards the front, which encircle the rear of ferrule segments 14 between them and the first hooks.

This assembly holds the sectors 1 against the movements produced by the radial and axial forces oriented towards the rear during operation. Assembling these conventional devices is difficult to carry out, as the inclined sectors 1 have to be disposed in the casing 7 so that the rear flange 3 can be inserted in the second hook 10 before making them pivot about the end hook 4 at the front, so that the end hook 5 can be inserted behind the hooks 10 with a radial movement towards the outside. In order to effect this assembly, it is necessary to have two major sets of rotor-stator in the internal stream, with such a requirement being detrimental to the seals between rotor and stator. Finally, probably the most serious disadvantage of this assembly is the fact that the hooks 6 and 10 are integrally formed with the casing 7, being subjected to significant mechanical and thermal stresses since they are near the stream of hot gases. As such, it becomes necessary to construct the hooks 6 and 10 and the casing 7 from a sufficiently resistant material even though the casing 7 is subjected to a lower temperature. In addition, due to the integral construction, fatigue cracking can appear in the hooks 6 and 10 and spread to the point where the entire casing 7 needs to be replaced.

Therefore, a need exists to rectify the design of the above-described casing, which is both costly and fragile, while enabling straightening sectors to be mounted more simply and producing a more rigid and less complex assembly. The instant invention satisfies these various requirements.

SUMMARY OF THE INVENTION

In its most general form, the present invention relates to the assembly of sectors of a distributor ring on a casing, the sectors comprising two flanges fitted with support faces on the casing, a hook being disposed beneath a curved edge of one of the flanges to support the sectors against centripetal movements, characterised in that the assembly comprises a support plate placed between the flanges; and means for fixing the support plate to the casing, the hook being placed on the support plate, the support plate and the casing comprising flat mutual support faces oriented in an axial direction, fixing means comprising slugs passing radially through the casing, the support plate being retained between the casing and the slugs, and the support plate having a mounting direction towards the flange having said curved edge.

The hook, which is the most stressed part of the assembly, may now be constructed with increased freedom for the choice of materials because it is disposed on a support plate and thus separated from the casing; it may be more easily replaced, if required; and finally, mounting is effected via linear movement of the sole support plate rather than the more complicated joint pivoting movement of the sectors in conventional assemblies.

The assembly may be further simplified if the hook comprises a conical external face at least on a central portion under the curved edge tapering towards the flange having the curved edge.

It should be noted that documents U.S. Pat. No. 3,892,497 and U.S. Pat. No. 5,618,161 disclose arrangements where distributor sectors are retained by carriers of a hook which is thus separated from the casing, but the end plates are placed otherwise and are not mounted by translation, but by tilting. They must be divided into sectors: the arrangement and mounting remain complicated.

BRIEF DESCRIPTION OF THE DRAWINGS

Other arrangements, which can be adapted in addition to the above, multiply the advantages, which the invention provides. Its various aspects will emerge better from the following description of the figures, in which.

DETAILED DESCRIPTION OF THE PREFERRED EMBODIMENTS

Figure 2:
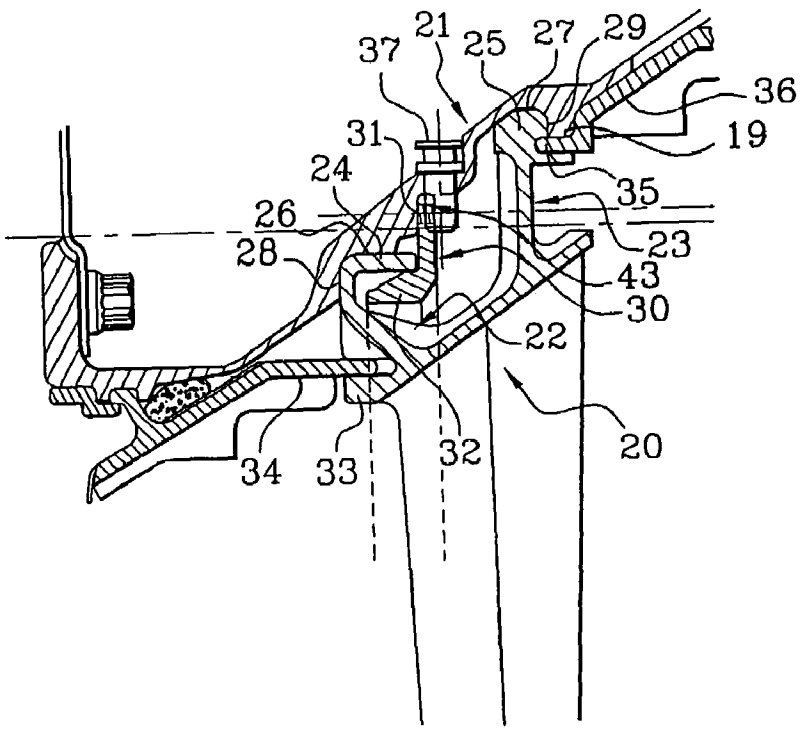
Fig. 2 PRIOR ART
FIG. 2 shows the assembly of the invention.

The casing is now designated by reference numeral 21, but its general form resembles that of the previous one; its diameter decreases towards the front and its form is thus slightly conical at the point of the invention.

The new straightening sectors are designated by reference 20 and comprise, as before, flanges 22 and 23 at the front and at the rear are fitted with end hooks 24 and 25, both curved towards the rear; the end hooks 24 and 25 are here supported on the casing 21 by mutual support faces 26 and 27, oriented in a radial direction, and by flat support faces 28 and 29, axially oriented and opposite to each other. Contrary to the above-noted conventional design, assembly of the new straightening sectors is simplified and made more stable. An essential element of the invention is a support plate 30 supported on the casing 21 by flat mutual support faces 31 and oriented in an axial direction, the support plate 30 comprising on its edge a hook 32 facing the front and passing under the end hook 24 of the first flange 22. The support plate 30 extends on a full turn. As previously, the straightening sectors 20 bear towards the front a projection 33 for retaining the adjacent ferrule sectors 34 underneath.

Another projection 35 can be noticed; it is found under the second end hook 25 and its purpose is to support ferrule sectors 35 opposite the preceding.

Slugs 37 are adjusted through the casing 21 in a radial direction, and keep the support plate 30 supported against the casing 21 by engaging behind the latter to block it axially.

The hook 6 of the conventional casing 7 has been eliminated, with the hook 32 of the support plate 30 replacing it, such that a weak point of the casing 7 has been eliminated. The hook 10 for the other flange 3 has not been eliminated completely, since the second end hook 25 is placed behind a groove 19 of the casing 21, which ensures the same support functions for the flange 23, but it should be emphasised that the groove 19, more massive and less protruding than the hook 10, is much less stressed. Such modification of the hook 10 in the design of FIG. 1 would have been of little use, as long as the hook 6 was there, which had to project substantially to enable the straightening sectors 1 to be mounted by an axial then pivoting movement. In summary, eliminating the weak point of the casing 7 constituted by the hook 6 allows the elimination of the other weak point constituted by the hook 10.

Eliminating hooks 6 and 10 or replacing them by simpler structures decreases stress and the risk of failure of the casing 21, while, at the same time, simplifying the casing manufacture process. The casing 21 now may be constructed from a less resistant material than the one used for casing 7. Only the hook 32 and its support plate 30 remain subjected to high temperatures, thus requiring the use of a more resistant material.

Figure 3:
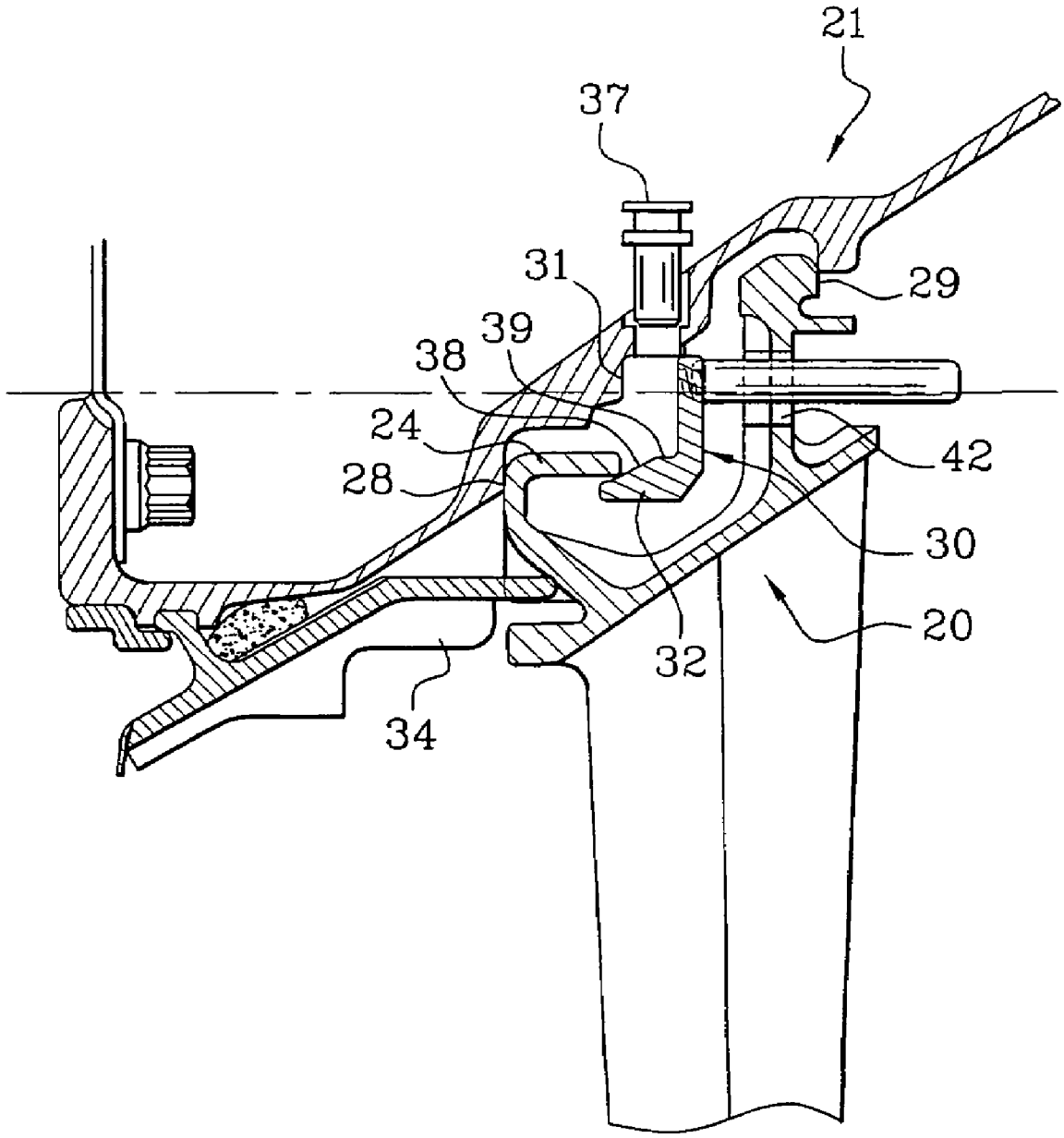
FIG. 3 evokes the mode of assembly.

As shown in FIG. 3, the straightening sectors 20 may be raised by a purely radial movement as the pairs of support faces 28 and 29 slide upward as the support plate 30 is moved towards the front as far as the stop of faces 31. The hook 32 is fitted with an external face of which at least one central surface 38 is conical, tapering towards the front, making the first end hook 24 rise onto this surface 38, while the hook 32 advances. When the end hook 24 passes this surface 38 to rest on a rear cylindrical portion 39 of the upper surface of the hook 32, the straightening sectors 20 have been put into place. Then, the slugs 37 are to be introduced to their bores to axially block the support plate 30.

The movement of the support plate 30 towards the front can be made very simply by a special tool, as often found for carrying out assembly and disassembly work of turbomachines. An appropriate tool would comprise a platen mounted in the casing supporting the straightening sectors 1, as well as thrusters for pressing on the rear of the support plate 30 through holes 42 hollowed through the other flange 23.

It should be emphasised that one of the main stresses being exerted on the straightening sectors 1 or 20 is a force to the rear, produced by the flow of air across the latter. This force is translated by a tilting motion around support points of the sectors on the casing 7 or 21 and by a centripetal radial force on the hook 6 or 32, which makes it vulnerable, but the consequences of breaking would be less serious on the hook 32 than on the hook 6, since it would be enough to replace the support plate 30 instead of the entire casing 7. The hook 32 offers radial support to the inside on sectors 20, just like the hook 6 on the sectors 1, since the end hook 24 is placed on the latter, but it offers more rigid assembly than the hook 6, even though it is not all in one with the casing 21, by keeping the end hook 24 pressed against the casing 21 on the support faces 26. The diameter of a surface portion of the rear portion 39 can be selected to exert the desired pressing force at this point.

The conicity of the surface 38 always allows the support plate 30 to be placed without difficulty, with the hook 32 acting as a corner. Assembly is still stiff, while being simplified, if the ferrule sectors 36 to the rear comprise a projecting front end 43 placed on the projection 35 and introduced on the end hook 25 of the flange 23 in the place of the clip 12.

If the support plate 30 must be replaced, it is easy to extract it if tapping points are put in place, such as internal screw threads 53, which allow it to be gripped by threaded axes introduced through the holes 42, and to be extracted by drawing it to the rear until the straightening sectors 20 are released.

Figure 1:
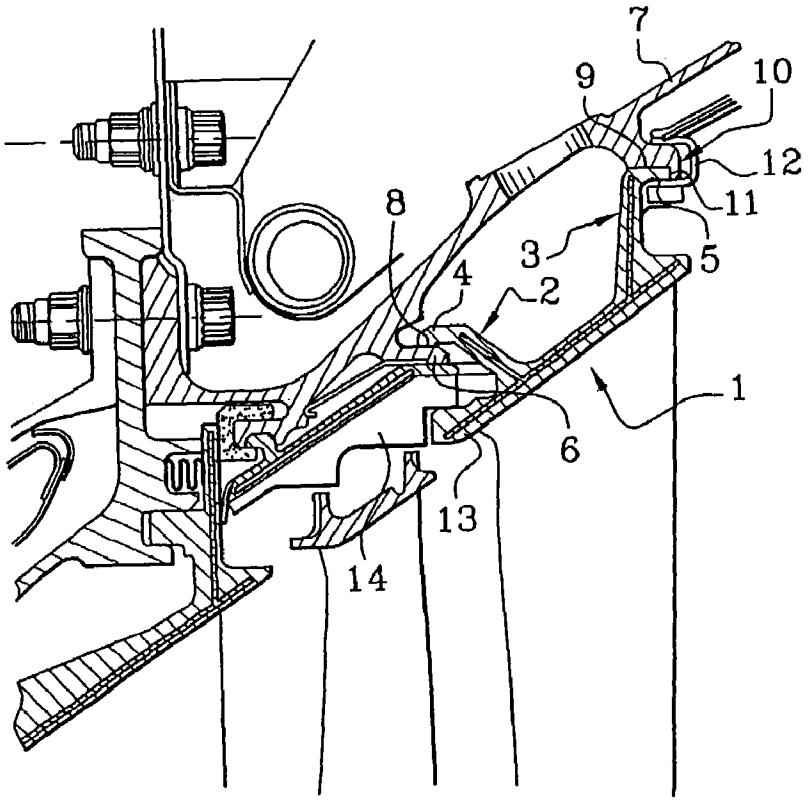
FIG. 1 already described, has the characteristic of an earlier assembly.

It should be noticed that the end hook 24 of the first flange 22 was directed to the rear, and the hook 32, with which the first flange is assembled, was directed towards the front, contrary to the traditional arrangement as in FIG. 1. The advantage of this inversion, made possible by eliminating the pivoting movement when mounting the straightening sectors 20, is that the hook 32 and its support plate 30 are lodged between the flanges 22 and 23, in a volume isolated from the temperature of the gases by the distributor sector 20.

The invention claimed is:

1. An assembly comprising:

a casing;

sectors of a ring, one of the sectors carrying a fixed blade;

a circular support plate comprising a hook and configured to be mounted by moving in an axial direction;

means for removably mounting the support plate inside the casing, the means comprising a slug passing radially through the casing;

the sectors each comprising two hook-shaped flanges for removably mounting said sectors inside the casing;

the support plate being placed between the flanges, the casing and the support plate comprising flat faces of radial orientation, the support plate being axially retained between said support faces and said slug;

said hook of the support plate extending in the axial direction, an end of one of said flanges being retained between the casing and said hook in a radial direction of the casing, wherein the hook comprises a conical external face at least on a central portion thereof tapering towards the radially retained flange.

2. An assembly comprising:

a casing;

sectors of a ring, one of the sectors carrying a fixed blade;

a circular support plate comprising a hook and configured to be mounted by moving in an axial direction;

means for removably mounting the support plate inside the casing, the means comprising a slug passing radially through the casing;

the sectors each comprising two hook-shaped flanges for removably mounting said sectors inside the casing;

the support plate being placed between the flanges, the casing and the support plate comprising flat faces of radial orientation, the support plate being axially retained between said support faces and said slug;

said hook of the support plate extending in the axial direction, an end of one of said flanges being retained between the casing and said hook in a radial direction of the casing; and ferrule sectors adjacent to the sectors, said ferrule sectors being retained between a curved edge of and projections of another one of said flanges in a radial direction of the casing.

3. An assembly comprising:

a casing;

sectors of a ring, one of the sectors carrying a fixed blade;

a circular support plate comprising a hook and configured to be mounted by moving in an axial direction;

means for removably mounting the support plate inside the casing, the means comprising a slug passing radially through the casing;

the sectors each comprising two hook-shaped flanges for removably mounting said sectors inside the casing;

the support plate being placed between the flanges, the casing and the support plate comprising flat faces of radial orientation, the support plate being axially retained between said support faces and said slug;

said hook of the support plate extending in the axial direction, an end of one of said flanges being retained between the casing and said hook in a radial direction of the casing, wherein, the hook comprises a conical external face tapering towards one of the flanges, the flanges comprise two faces of radial orientation and two faces of axial orientation for support of the sectors inside the casing, and, when assembling the assembly, the sectors are configured to be raised substantially in a radial movement, as the two faces of axial orientation of the flanges slide upward on corresponding faces disposed on the casing as the support plate is moved toward the front until the faces faces of radial orientation abut each other and the one of the flanges passes the conical external face of the hook to rest on a rear cylindrical portion of an upper surface of the hook, and the slug is introduced through the casing to axially block the support plate in place.

4. An assembly comprising:

a casing having an axial direction and a radial direction perpendicular to the axial direction, the casing comprising, an opening extending radially through the casing, and first, second, and third abutment surfaces, the first and third abutment surfaces comprising radially and axially extending portions and being disposed on opposite sides of the opening, the second abutment surface comprising an axially extending portion and being disposed next to the opening;

sectors of a ring, one of which having a fixed blade, the sectors being configured to be removably mounted to the casing and comprising first and second hook-shaped flanges configured to removably mount the sectors inside the casing, the first and second hook-shaped flanges comprising radially and axially extending portions corresponding to the radially and axially extending portions of the first and third abutment surfaces of the casing, respectively;

a support plate comprising a hook and a radially extending surface corresponding to the second abutment surface of the casing, the support plate being placed between the first and second hook-shaped flanges, said hook of the support plate extending in an axial mounting direction of the support plate and of the sectors, an end of the first hook-shaped flange being retained between the casing and said hook in the radial direction of the casing;

a slug passing radially through the casing, the slug being configured to axially retain the support plate in place, wherein the hook comprises a conical external face at least on a central portion thereof tapering towards the first hook-shaped flange.

5. An assembly comprising:

a casing having an axial direction and a radial direction perpendicular to the axial direction, the casing comprising, an opening extending radially through the casing, and first, second, and third abutment surfaces, the first and third abutment surfaces comprising radially and axially extending portions and being disposed on opposite sides of the opening, the second abutment surface comprising an axially extending portion and being disposed next to the opening;

sectors of a ring, one of which having a fixed blade, the sectors being configured to be removably mounted to the casing and comprising first and second hook-shaped flanges configured to removably mount the sectors inside the casing, the first and second hook-shaped flanges comprising radially and axially extending portions corresponding to the radially and axially extending portions of the first and third abutment surfaces of the casing, respectively;

a support plate comprising a hook and a radially extending surface corresponding to the second abutment surface of the casing, the support plate being placed between the first and second hook-shaped flanges, said hook of the support plate extending in an axial mounting direction of the support plate and of the sectors, an end of the first hook-shaped flange being retained between the casing and said hook in the radial direction of the casing;

a slug passing radially through the casing, the slug being configured to axially retain the support plate in place; and ferrule sectors adjacent to the sectors, said ferrule sectors being retained between a curved edge of and projections of the second hook-shaped flange.

6. An assembly comprising:

a casing having an axial direction and a radial direction perpendicular to the axial direction, the casing comprising, an opening extending radially through the casing, and first, second, and third abutment surfaces, the first and third abutment surfaces comprising radially and axially extending portions and being disposed on opposite sides of the opening, the second abutment surface comprising an axially extending portion and being disposed next to the opening;

sectors of a ring, one of which having a fixed blade, the sectors being configured to be removably mounted to the casing and comprising first and second hook-shaped flanges configured to removably mount the sectors inside the casing, the first and second hook-shaped flanges comprising radially and axially extending portions corresponding to the radially and axially extending portions of the first and third abutment surfaces of the casing, respectively;

a support plate comprising a hook and a radially extending surface corresponding to the second abutment surface of the casing, the support plate being placed between the first and second hook-shaped flanges, said hook of the support plate extending in an axial mounting direction of the support plate and of the sectors, an end of the first hook-shaped flange being retained between the casing and said hook in the radial direction of the casing;

a slug passing radially through the casing, the slug being configured to axially retain the support plate in place, wherein, the hook comprises a conical external face tapering towards the first hook-shaped flange, and, when assembling the assembly, the sectors are configured to be raised substantially in a radial movement as the radially extending portions of the first and second hook-shaped flanges slide upward on the corresponding faces of the first and third abutment surfaces of the casing as the support plate is moved toward the front until the radially extending surface of the support plate abuts the corresponding axially extending portion of the second abutment surface of the casing and the first hook-shaped flange passes the conical external face of the hook to rest on a rear cylindrical portion of an upper surface of the hook, and the slug is introduced through the casing to axially block the support plate in place.

* * * * *